US008453266B2

(12) United States Patent
Bevier et al.

(10) Patent No.: US 8,453,266 B2
(45) Date of Patent: Jun. 4, 2013

(54) ERGONOMIC CURVED ATHLETIC GLOVE

(75) Inventors: Joseph J. Bevier, Portland, OR (US); Mark McNamee, Portland, OR (US)

(73) Assignee: Nike, Inc., Beaverton, OR (US)

( * ) Notice: Subject to any disclaimer, the term of this patent is extended or adjusted under 35 U.S.C. 154(b) by 242 days.

(21) Appl. No.: 12/794,868

(22) Filed: Jun. 7, 2010

(65) Prior Publication Data

US 2011/0296582 A1 Dec. 8, 2011

(51) Int. Cl.
*A41D 19/00* (2006.01)

(52) U.S. Cl.
USPC ..... 2/161.1

(58) Field of Classification Search
USPC ..... 2/161.1, 161.6, 163
See application file for complete search history.

(56) References Cited

U.S. PATENT DOCUMENTS 3,760,425 A * 9/1973 Komatsu ..... 2/169
4,051,552 A * 10/1977 Widdemer ..... 2/161.5
4,472,836 A 9/1984 Shikatani
4,494,249 A 1/1985 Hansson
4,594,736 A * 6/1986 Connelly ..... 2/163
4,815,147 A 3/1989 Gazzano et al.
5,581,809 A 12/1996 Mah
5,946,720 A 9/1999 Sauriol
6,415,445 B1 7/2002 Nishijima et al.
6,629,911 B2 10/2003 Cook
6,732,378 B2 * 5/2004 Novak ..... 2/161.6
6,745,402 B2 6/2004 Caswell
6,862,744 B2 3/2005 Kuroda et al.
6,959,453 B2 11/2005 Best
7,062,791 B2 6/2006 Gold
7,318,241 B2 1/2008 Morrow
2008/0000008 A1 1/2008 Nagao et al.
2009/0077714 A1 * 3/2009 Baacke ..... 2/167

* cited by examiner

*Primary Examiner* — Katherine Moran
(74) *Attorney, Agent, or Firm* — Shook, Hardy & Bacon L.L.P.

(57) ABSTRACT

An ergonomic curved athletic glove is provided. The glove comprises palm and back portions as well as four finger sheaths and a thumb sheath, each sheath having a front and back finger portion and one or more gussets. The thumb, pinky, and index finger sheaths may incorporate a "seamless" design that avoids seams where the glove comes in contact with a sporting implement and reduces potential gripping interference. The palm portion of the glove may comprise multiple sections connected with a stretchable palm gusset to minimize bunching when a sporting implement is gripped. The length of each front finger portion is shorter than the length of the corresponding back finger portion to provide the glove with a gripping curve. Providing the glove with a gripping curve minimizes bunching of the front finger portions, front thumb portion, and palm portion while a received hand grips the sporting implement.

17 Claims, 6 Drawing Sheets

ERGONOMIC CURVED ATHLETIC GLOVE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to athletic gloves. More particularly, the present invention relates to an ergonomic curved athletic glove that provides an enhanced gripping experience by reducing bunching of the glove while a sporting implement, such as a bat or ball, is being gripped.

BACKGROUND

Both professional and amateur athletes often wear athletic gloves to enhance gripping of sporting implements. Baseball and softball players, for example, often wear batting gloves to enhance their grip on the handle of the baseball or softball bat. Similarly, football players such as wide receivers, tight ends, and running backs often wear gloves to enhance their grip on the football. Conventional athletic gloves are typically designed with the palm side and back side of the gloves being approximately the same length such that the gloves lay flat when not in use. The human hand, however, is curved in its relaxed state and becomes even more curved while gripping a sporting implement such as a bat or ball. An undesirable side-effect of a flat glove worn in a curved hand position is bunching of the palm side of the glove surface. As a gloved hand closes to grip a sporting implement, bunching occurs in the surfaces covering the fingers and thumb as well as the palm itself. This bunching can negatively impact grip. Additionally, glove seams that come in contact with the gripping surface of the sporting implement can interfere with gripping. In conventional athletic gloves, seams are often present along the insides of the thumb and fingers and across the palm portion of the glove.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments of the present invention relate to a curved ergonomic athletic glove. The glove comprises a palm portion. A front thumb portion and front index, middle, ring, and pinky finger portions extend from the palm portion. A back portion is connected to the palm portion such that an opening capable of receiving a human hand is formed between the back portion and the palm portion. The opening is located on the side of the glove opposite the front finger portions. A back thumb portion and back index, middle, ring, and pinky finger portions extend from the back portion. Fewer thumb and/or finger portions may be used for a partially fingerless glove. Two pairs of finger gussets may connect each of the corresponding front and back middle and ring finger portions. At least one finger gusset may connect each of the front and back index finger portions, the front and back pinky finger portions, and the front and back thumb portions.

In one embodiment, the length of each front finger portion and front thumb portion may be selected to form a curve substantially the same as the position of a received hand gripping a sporting implement. Providing the glove with a gripping curve minimizes bunching of the front finger portions and front thumb portion while a received hand grips the sporting implement. The shorter the front finger portions are relative to the back finger portions, the greater the degree of curve. The length of each back finger portion and back thumb portion may be determined by the length of the corresponding front finger portion, which in turn may be determined by the degree of curve necessary to grip the sporting implement Like the length of the front and back finger and thumb portions, the curve of each finger gusset may be determined by the curve necessary to grip the sporting implement.

In another embodiment, the palm portion of the glove comprises multiple sections. A palm gusset made of a stretchable material may connect the multiple sections of the palm portion. The palm gusset may take a variety of shapes. The palm gusset allows the palm portion to expand when a received hand is opened from a gripping position. While the hand is in a gripping position, the palm gusset minimizes bunching of the palm portion by contracting and bringing the multiple sections of the palm portion close together. Palm portion seams that are in contact with the sporting implement are minimized.

In still another embodiment, only one finger gusset connects the front and back thumb portions. The finger gusset connects the portions along the area corresponding to the outside of the thumb when the glove is worn by a user. The front and back thumb portions are a continuous piece of material such that when the glove is worn and a sporting implement is gripped in a proper gripping position, no thumb seams come in contact with the sporting implement.

BRIEF DESCRIPTION OF THE DRAWINGS

The present invention is described in detail below with reference to the attached drawing figures, wherein.

DETAILED DESCRIPTION

Figure 1:
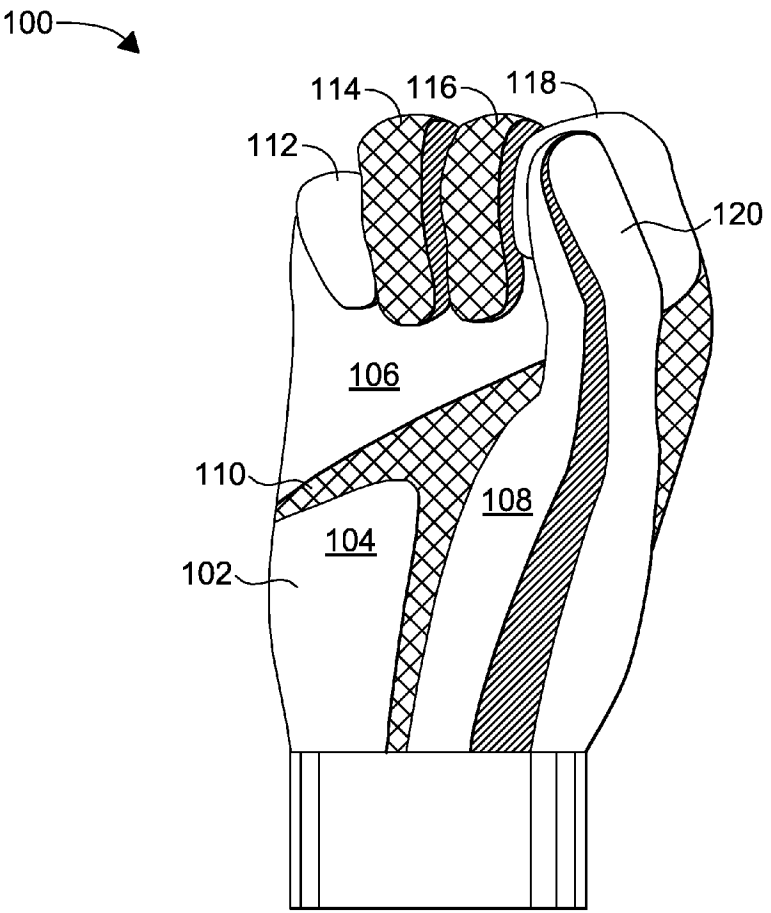
FIG. 1 is a perspective view of an exemplary embodiment of an ergonomic curved athletic glove.
Figure 3:
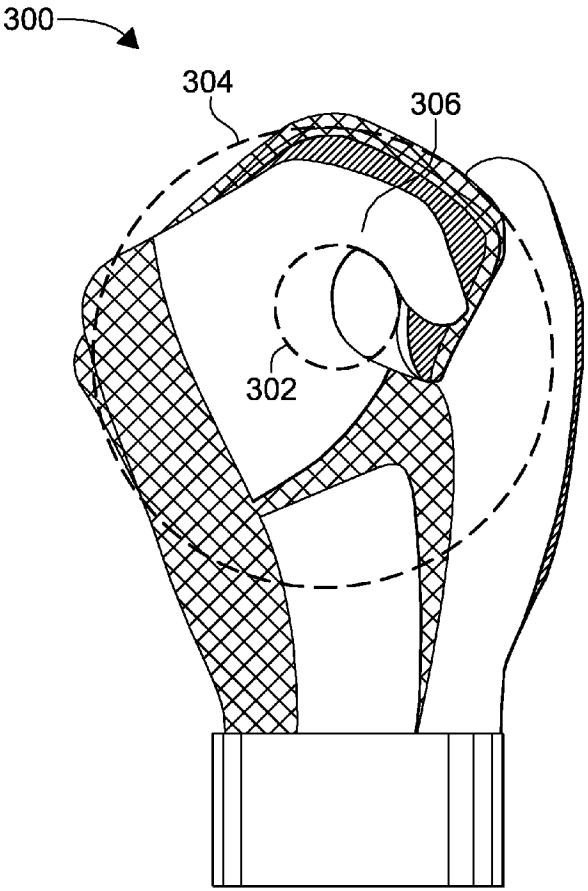
FIG. 3 is a perspective view of an exemplary embodiment of an ergonomic curved athletic glove illustrating the thumb and index finger side of the glove and indicating the approximate dimensions of a gripped baseball or softball bat.

Referring now to FIG. 1, an ergonomic curved athletic glove 100 capable of receiving a human hand is shown in a curved position. Glove 100 has a palm portion 102 comprising multiple sections 104, 106, and 108. Sections 104, 106, and 108 are connected by palm gusset 110. In some embodiments, palm gusset 110 forms an approximate "T" shape as shown in FIG. 1. If used, however, palm gusset need not be a "T" shape, but rather may be any shape, such as polygonal or arcuate. Palm gusset 110 allows palm portion 102 to expand to accommodate opening a received hand from a gripping position. Palm gusset 110 stretches to allow sections 104, 106, and 108 to separate from each other. When glove 100 is in a gripping position, palm gusset 110 minimizes bunching of palm portion 102 by contracting and bringing sections 104, 106, and 108 close together. Palm gusset 110 is preferably made of a stretchable material to allow contraction and expansion as a received hand opens and closes. Different arrangements and numbers of sections of palm portion 102 and palm gusset 110 are contemplated in other embodiments. In some embodiments, palm gusset 110 is not included in glove 100. In such embodiments, palm portion 102 is either a single piece of material or is composed of multiple pieces of material connected together. In embodiments without a palm gusset that incorporate "seamless" finger design as discussed below, the area of palm portion 102 adjacent to thumb sheath 108 may be a separate piece of material attached to a main section of palm portion 102. Glove 100 fits a right hand. A glove that fits a left hand, such as the glove 300 shown in FIG. 3, is also contemplated.

Figure 2B:
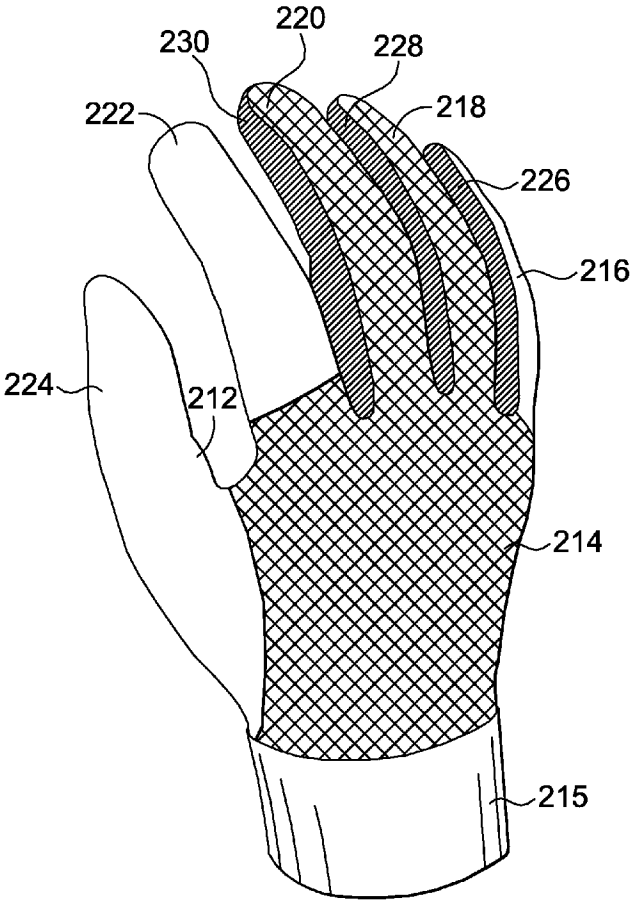
FIG. 2B is a perspective view of an exemplary embodiment of an ergonomic curved athletic glove in an open state illustrating the back portion and back finger portions of the glove.
Figure 2A:
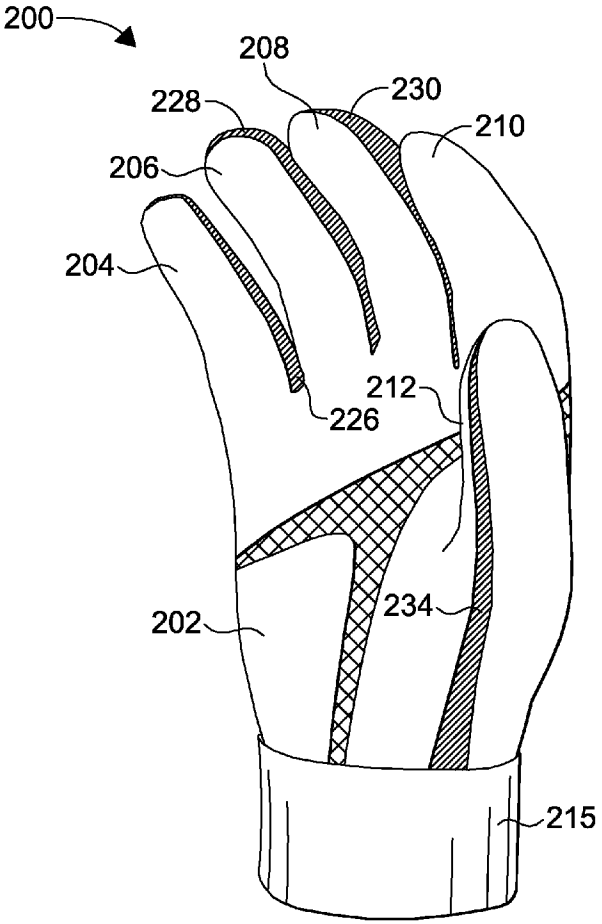
FIG. 2A is a perspective view of an exemplary embodiment of an ergonomic curved athletic glove in an open state illustrating the palm portion and front finger portions of the glove.

Referring again to FIG. 1, glove 100 includes four finger sheaths 112, 114, 116, and 118, and a thumb sheath 120, that are designed in a curve substantially the same as the amount of curve necessary to grip a sporting implement such as a baseball or softball bat. One or more sheaths may be omitted if a partially fingerless glove is desired. In a partially fingerless glove, an opening may permit a finger or thumb to extend from glove 100 rather than encasing the finger or thumb in a sheath. In some embodiments, glove 100 is designed with an amount of curve appropriate for gripping a football or other ball. In some embodiments, finger sheaths 112, 114, 116, and 118 and thumb sheath 120 are made of a sufficiently stretchable material such that after glove 100 has received a hand, the finger and thumb sheaths, in conjunction with palm gusset 110, allow the hand to open substantially, as shown in FIGS. 2A and 2B. To more easily illustrate various features, glove 100 will now be discussed with reference to FIGS. 2A and 2B, depicting glove 200 in an "open state."

Now referring to FIG. 2A, ergonomic curved athletic glove 200 includes palm portion 202. Front pinky finger portion 204 extends from palm portion 202 and has a front pinky finger length. Similarly, front ring finger portion 206 having a front ring finger length, front middle finger portion 208 having a front middle finger length, front index finger portion 210 having a front index finger length, and front thumb portion 212 having a front thumb length also extend from palm portion 202. In some embodiments, front finger portions 204, 206, 208, and 210 are one continuous piece of material, as shown in FIG. 2A. In other embodiments, front finger portions 204, 206, 208, and 210 comprise multiple sections connected by one or more gussets. In some embodiments, front finger portions 204, 206, 208, and 210, front thumb portion 212, and palm portion 202 are made of synthetic leather. In other embodiments, front finger portions 204, 206, 208, and 210, front thumb portion 212, and palm portion 202 are made of leather or a combination of leather and synthetic leather.

Glove 200 is further illustrated in FIG. 2B. Glove 200 includes a back portion 214. Back portion 214 is connected to palm portion 202 of FIG. 2A such that an opening capable of receiving a human hand (not pictured) is formed between back portion 214 and palm portion 202, the opening opposite the front finger portions. In some embodiments, a wrist strap 215 is connected to palm portion 202 and back portion 214 along the edge of the opening. Wrist strap 215 may include an adjustable fastener (not shown) to secure glove 200 to a received hand. Back pinky finger portion 216 extends from back portion 214 and has a back pinky finger length. Similarly, back ring finger portion 218 having a back ring finger length, back middle finger portion 220 having a back middle finger length, back index finger portion 222 having a back index finger length, and back thumb portion 224 having a back thumb length also extend from back portion 214. In some embodiments, back portion 214, back finger portions 216, 218, 220, and 222, and back thumb portion 224 are made substantially of a stretchable material.

Figures 7A, 7B:
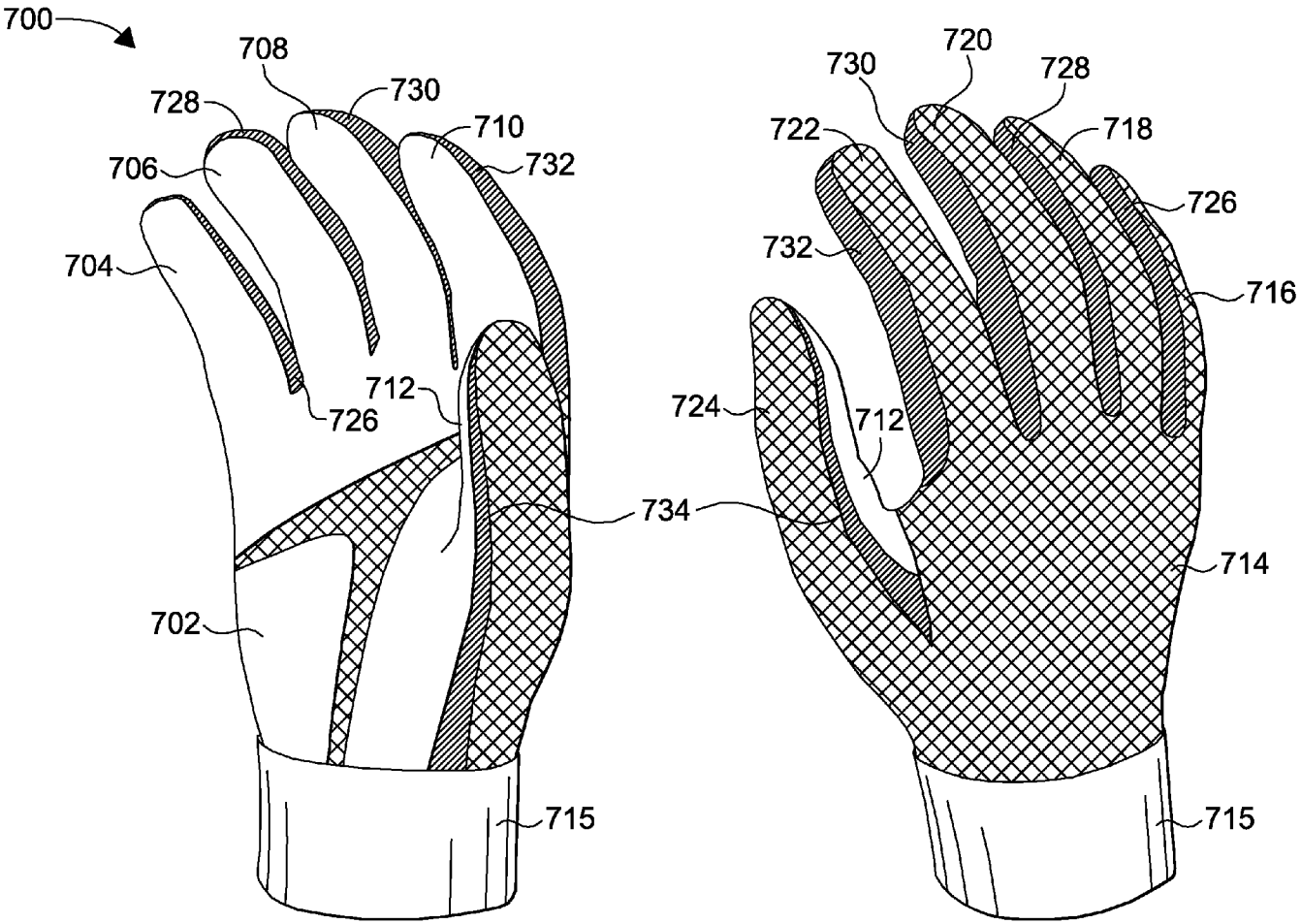
FIG. 7A is a perspective view of an exemplary embodiment of an ergonomic curved athletic glove in an open state illustrating the palm portion and front finger portions of the glove, the glove having two finger gussets on each finger and thumb.
FIG. 7B is a perspective view of an exemplary embodiment of an ergonomic curved athletic glove in an open state illustrating the back portion and back finger portions of the glove, the glove having two finger gussets on each finger and thumb.

With reference now to both FIGS. 2A and 2B, glove 200 also includes two curved finger gusset pairs 228 and 230. Curved finger gusset pair 228 connects front ring finger portion 206 and back ring finger portion 218. Curved finger gusset pair 230 connects front middle finger portion 208 and back middle finger portion 220. In some embodiments each pair of front and back finger portions includes a curved finger gusset pair (as illustrated in FIGS. 7A-7B). In other embodiments, the index finger, pinky finger, and/or thumb portion pairs are each connected with only one gusset. Such an embodiment is illustrated in FIGS. 1-4. In FIGS. 2A and 2B, front index finger portion 210 and back index finger portion 222 are connected via a curved finger gusset on the inside of the index finger (not visible from the perspective of the figures). The gusset is similar to one of the gussets of curved finger gusset pair 230. Curved finger gusset 226 connects front pinky finger portion 204 and back pinky finger portion 216. Similarly, curved finger gusset 234 connects front thumb portion 212 and back thumb portion 224.

In embodiments that include only one finger gusset for the thumb, index finger, and/or pinky finger sheath, a substantial area of the front and back portions of each finger or thumb sheath are continuous. For example, front thumb portion 212 and back thumb portion 224 are a continuous piece of material connected together by gusset 234. Because front thumb portion 212 and back thumb portion 224 are continuous, seams are absent from the inside of the thumb sheath. As used herein, "inside" refers to the side of a finger sheath nearer to the center of the hand, and "outside" refers to the side of a finger sheath farther from the center of the hand. For example, in the right-handed glove pictured in FIGS. 2A and 2B, the "inside" of the thumb sheath is on the right side of the thumb sheath—the side of the thumb nearest to the index finger, and the "outside" of the thumb sheath is on the left side—the side of the thumb sheath that forms the edge of glove 200. The term "inside" is not used to reference the volume enclosed by glove 200 that is capable of receiving a hand.

When glove 200 is worn, the area along the inside of the thumb sheath often comes into contact with a sporting implement when the sporting implement is being gripped. The "seamless" design provided by having only a single gusset on the outside of the thumb sheath allows a user wearing the glove and gripping a sporting implement to have an enhanced gripping experience by eliminating seams that would have created discomfort or interfered with contact between the user's hand and the sporting implement. The "seamless" index finger sheath illustrated in FIGS. 2A and 2B does not have seams on the outside (thumb side) of the index finger sheath because front index finger portion 210 and back index finger portion 222 are one continuous piece of material connected by a finger gusset on the inside of the index finger sheath. Similarly, the "seamless" pinky finger sheath illustrated in FIGS. 2A and 2B does not have seams on the outside of the pinky finger sheath because front pinky finger portion 204 and back pinky finger portion 216 are substantially one continuous piece of material connected by finger gusset 226 on the inside of the pinky finger. Embodiments of the invention are contemplated in which any combination of thumb, pinky finger, and index finger sheaths incorporates a "seamless" design.

To achieve the glove curve as illustrated by glove 100 in FIG. 1, each front finger length is shorter than the corresponding back finger length. For example, referring again to FIGS. 2A and 2B, front index finger portion 210 is shorter than back index finger portion 222. The length difference between corresponding front and back finger portions depends upon the degree of glove curve. If the glove has a large amount of curve, the length difference between corresponding front and back finger portions is high. If the glove appears substantially open, the length difference is low. The amount of glove curve is determined by the amount of curve necessary to grip a sporting implement such as a baseball bat, softball bat, golf club, tennis racquet, badminton racquet, cricket bat, football, or other ball. Thus, the glove curve determines both the length of the front and back finger portions as well as the length difference between the corresponding front and back finger portions.

The glove curve also dictates the curve of finger gusset pairs 228 and 230 and single finger gussets 226 and 234, as well as the index finger gusset (not pictured). Because the finger gussets connect the front finger portions and corresponding back finger portions, whose length is determined based on the desired glove curve, the shape and curve of the curved finger gussets are therefore also determined by the glove curve. Finger gusset shape and curve are discussed further below.

Although only one side of each finger gusset pair is shown in FIGS. 2A and 2B, as "finger gusset pair" indicates, a gusset is present on both sides of the ring and middle fingers connecting the front finger portions and back finger portions. The two finger gussets in each finger gusset pair may be sized differently, because the curve and shape of each finger gusset is derived from the curve of the corresponding front finger portion as the front finger portion grips a sporting implement. In some embodiments, curved finger gusset pairs 228 and 230 and single finger gussets 226 and 234, as well as the index finger gusset, are made substantially or completely of a stretchable material.

As discussed above, the curved finger gussets, back portion, and back ring and middle finger portions shown in FIGS. 2A and 2B may be made entirely or substantially of a stretchable material. Back pinky finger portion 216, back index finger portion 222, and back thumb portion 224 may also be made of a stretchable material in other embodiments. Palm gusset 110 of FIG. 1 may also be made of a stretchable material. The stretchable material used in the curved finger gusset pairs, back portion, back finger portions, and palm gusset may be different for each piece according to the desired amount of stretch. The amount of desired stretch may depend on the range of movement desired for the particular part of the glove. In one embodiment, the palm gusset and back portion are made of a material that allows for more stretch than the curved finger gussets or back finger portions. In some embodiments, the stretchable material may be the same for each piece but still allow different amounts of stretch.

In some embodiments the same material that is used on the front finger and thumb portions may be used on part of the back finger portions. In one embodiment, the front finger portion material is used on the back finger portions in the area corresponding approximately to a received hand's fingernails.

Now referring to FIG. 3, glove 300 has a curve substantially the same as the curve necessary to grip a baseball or softball bat having a handle circumference 302 and a barrel circumference 304. Handle circumference 302 can be any circumference physically able to be gripped by a human hand. Often, bats have a diameter of between about one-half of an inch and two inches, with corresponding circumferences of between approximately 1.57 inches and 6.28 inches. Glove 300 is designed to grip the bat having handle circumference 302 such that bunching of the front finger surfaces and palm surface of glove 300 is minimized and such that thumb, index finger, and pinky finger sheath seams and palm seams in contact with the bat are minimized. "Seamless" design eliminates thumb, index finger, and pinky finger sheath seams that would conventionally come in contact with the bat.

Palm seams are reduced by placing the palm gusset (placement illustrated by palm gusset 110 in FIG. 1) below the area in which the bat comes in contact with glove 300. The length of front finger portions are selected to achieve the glove curve of glove 300. The length of back finger portions are determined based on the length of front finger portions. In index finger sheath 306 of glove 300, the front and back portions are one continuous piece, as described above with regard to FIGS. 2A and 2B. An index finger gusset is present on the opposite side of sheath 306. As detailed above, the seamless design of the index finger sheath eliminates seams that could interfere with gripping the bat.

For finger sheaths that have two gussets, each of the two gussets in the pair may have a different shape and curve. The fingers of the hand are not perfectly aligned while gripping a bat (or other sporting implement), and the finger gussets on either side of a particular finger that connect the front and back finger portions are of slightly different shape and curve. In some embodiments, both finger gussets of a pair may be substantially the same for simplicity in design and manufacturing.

Because finger gussets connect front and back finger portions, the curve and shape of a finger gusset is determined by the area between front finger portion and back finger portion that needs to be filled for connection. This area between front and back finger portions is determined based on the respective lengths of the two portions, which are selected to achieve the desired glove curve for gripping a bat handle having circumference 302. Thus, the sporting implement to be gripped determines desired curve as well as front finger length, back finger length, and finger gusset shape and curve for each finger and thumb.

Figure 4:
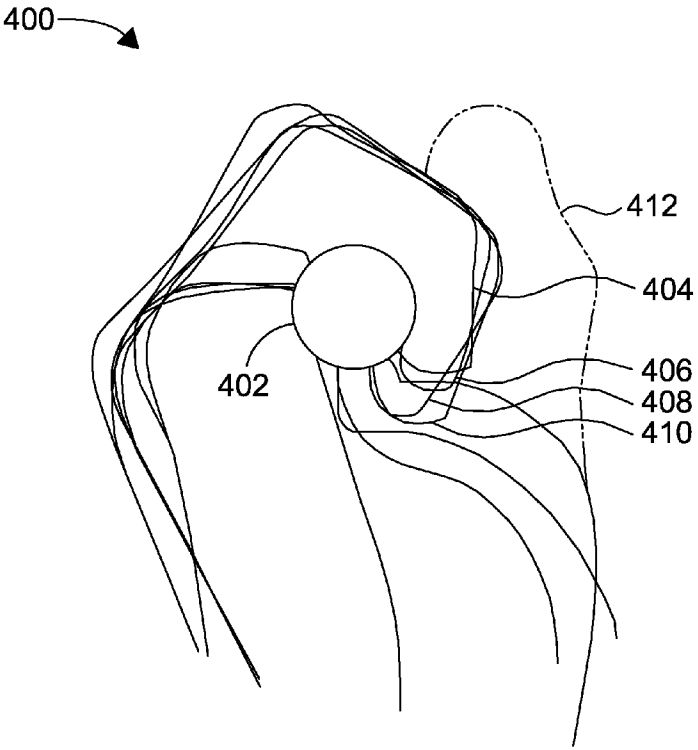
FIG. 4 is a partial, multi-layered cross-sectional view of the positions of the finger and thumb sheaths of an exemplary embodiment of an ergonomic curved athletic glove while a received hand is gripping a sporting implement.
Figure 5:
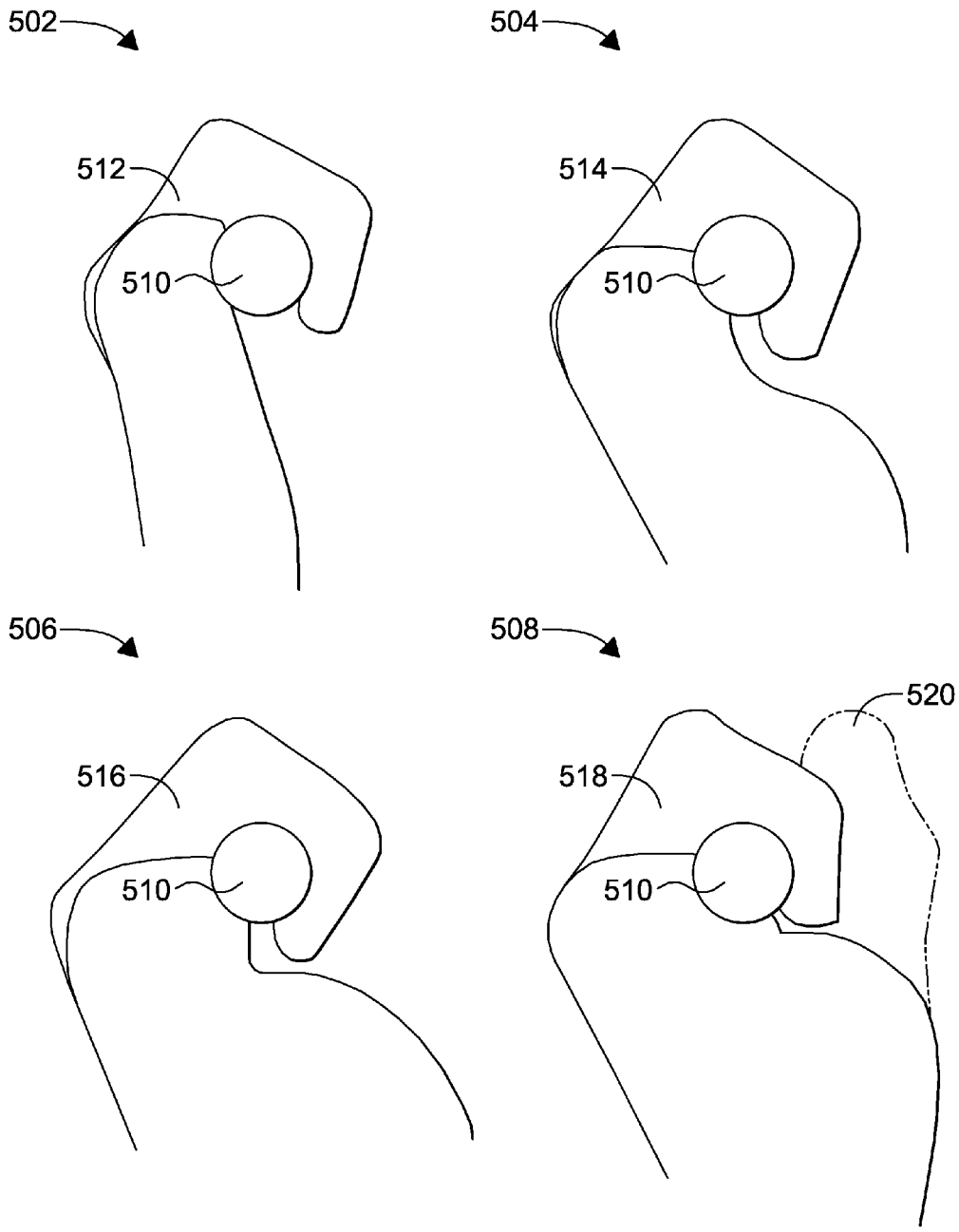
FIG. 5 illustrates separately each cross-sectional view in FIG. 4.

FIG. 4 is a simplified view of a curved ergonomic athletic glove 400 gripping a bat handle 402. Four finger sheath cross-sections 404, 406, 408, and 410 and thumb sheath cross-section 412 are shown to illustrate that each of the fingers of a received hand is in a slightly different position while gripping bat handle 402. Many professional athletes, as well as some amateurs, grip the bat handle primarily in the fingers as shown in FIG. 4 and FIG. 5 (discussed below) rather than primarily in the palm as is done by many amateurs. Placement of the palm gusset below the area where the bat comes in contact with the fingers and palm reduces seams in contact with the bat. Finger sheath cross-sections 404, 406, 408, and 410 and thumb sheath cross-section 412 are shown separately in FIG. 5.

Referring now to FIG. 5, cross-sections 502, 504, 506, and 508 illustrate the position of each finger of a received hand while the received hand is gripping bat handle 510 by showing four horizontal cross-sections, one through each corresponding finger sheath. Pinky cross section 502 is a cross-section of pinky finger sheath 512 gripping bat handle 510. Ring finger cross section 504 is a cross-section of ring finger sheath 514 gripping bat handle 510. Similarly, middle finger cross-section 506 and index finger cross-section 508 show cross-sections of middle finger sheath 516 and index finger sheath 518 gripping bat handle 510. Index finger cross section 508 additionally shows a cross-section of thumb sheath 520. As discussed above, the shape and curve of finger cross-sections 502, 504, 506, and 508 and thumb sheath cross-section 520 correspond to the shape of the finger gussets that connect the front and back finger portions of each finger as shown in FIGS. 2A and 2B. Finger gusset outlines corresponding to the finger sheath cross-sections in FIG. 5 are shown in FIG. 6.

Figure 6:
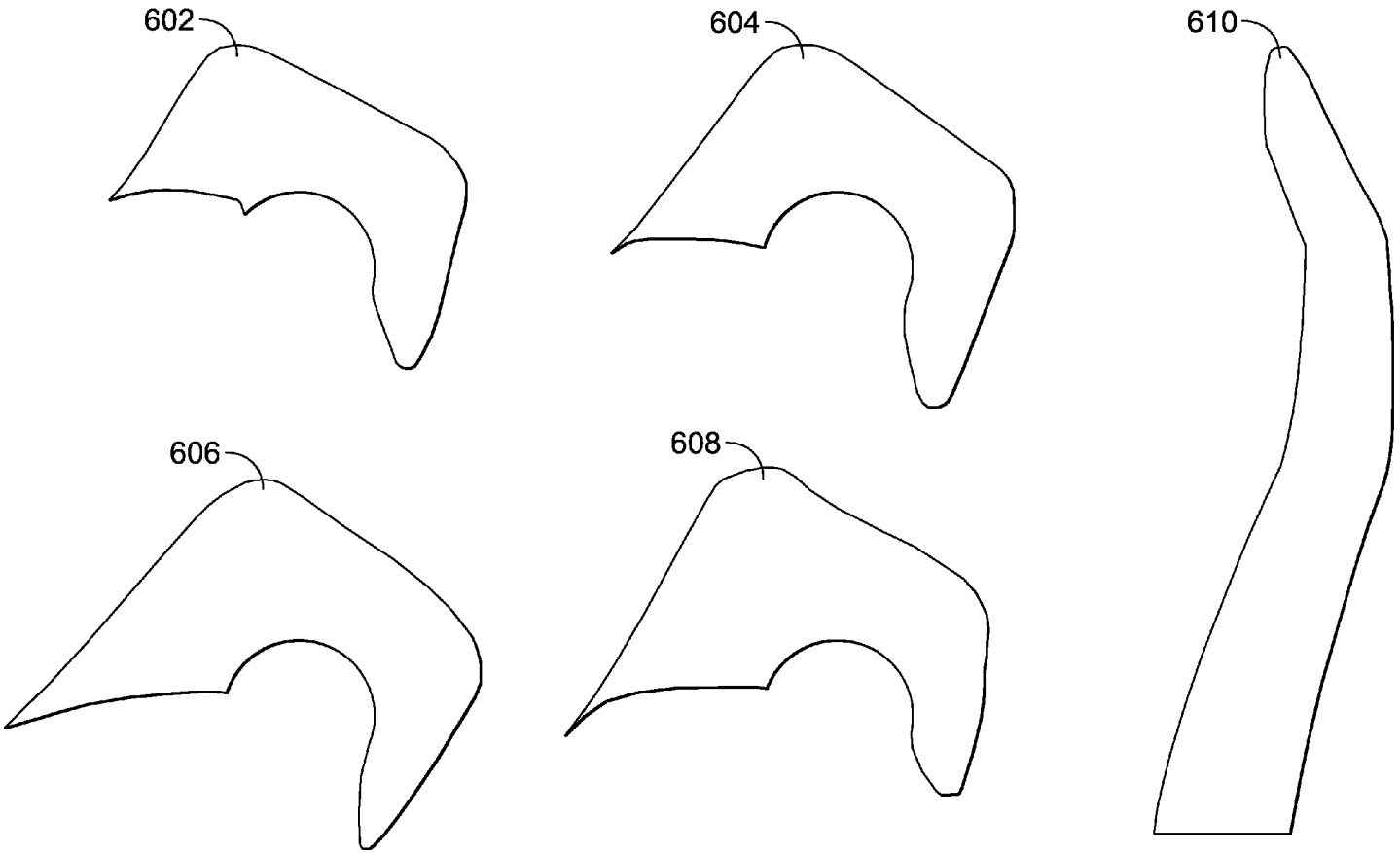
FIG. 6 is an elevated plan view of the finger gusset pairs of an exemplary embodiment of an ergonomic curved athletic glove having a neutral state approximating the position needed to grip a sporting implement.

With reference now to FIG. 6, pinky finger gusset outline 602 illustrates the shape and curve of the single pinky finger gusset of a "seamless" design for a glove designed with a curve approximating a bat handle gripping position, such as glove 300 in FIG. 3. Similarly, index finger gusset outline 608 and thumb gusset outline 610 show the shape and curve of the single finger gusset for a "seamless" design of the index finger and thumb sheaths. In some embodiments, each finger and thumb in a glove may incorporate seamless design. In such embodiments, each finger and thumb would only include one gusset. Seamless design may be more useful in some fingers than in others, depending upon the sporting implement the glove is designed to grip. Ring finger gusset pair outline 604 and middle finger gusset pair outline 606 show the approximate outline for each of the two gussets in the pair. As discussed above, the fingers of a hand gripping a roughly cylindrical sporting implement are not aligned perfectly, resulting in each finger having differently curved and shaped finger gussets. FIG. 6 illustrates one finger gusset per sheath. For fingers incorporating two finger gussets, each of the two gussets may have a slightly different curve and shape. In some embodiments, both finger gussets in a finger gusset pair have the same shape and curve.

The ergonomic curved athletic gloves illustrated in FIGS. 1-6 may be designed to fit a particular sporting implement or type of sporting implement. For example, a glove may be designed to grip a baseball bat handle or a softball bat handle. Gloves may be designed to fit a variety of other sporting implements such as golf clubs, tennis racquets, badminton racquets, cricket bats etc. A glove may be designed to grip, for example, a particular model of baseball bat or even a particular athlete's hand. A glove may also be designed to grip a football or other ball. In the case of a baseball or softball batting glove, glove design may consider curvature of the handle, length of the handle, diameter of the handle, and one or more preferred hand positions for gripping the handle. Preferred hand positions may include left and right-handed gripping positions as well as other gripping positions appropriate for bat.

FIGS. 7A and 7B illustrate an embodiment in which glove 700 has two gussets for each finger and thumb sheath rather than a "seamless" finger or thumb design. Glove 700 includes palm portion 702. Front pinky finger portion 704 extends from palm portion 702 and has a front pinky finger length. Similarly, front ring finger portion 706 having a front ring finger length, front middle finger portion 708 having a front middle finger length, front index finger portion 710 having a front index finger length, and front thumb portion 712 having a front thumb length also extend from palm portion 702. In some embodiments, front finger portions 704, 706, 708, and 710 are one continuous piece of material, as shown in FIG. 7A. In other embodiments, front finger portions 704, 706, 708, and 710 comprise multiple sections connected by one or more gussets. In some embodiments, front finger portions 704, 706, 708, and 710, front thumb portion 712, and palm portion 702 are made of synthetic leather. In other embodiments, front finger portions 704, 706, 708, and 710, front thumb portion 712, and palm portion 702 are made of leather or a combination of leather and synthetic leather.

Glove 700 is further illustrated in FIG. 7B. Glove 700 includes a back portion 714. Back portion 714 is connected to palm portion 702 of FIG. 7A such that an opening capable of receiving a human hand (not pictured) is formed between back portion 714 and palm portion 702, the opening opposite the front finger portions. In some embodiments, a wrist strap 715 is connected to palm portion 702 and back portion 714 along the edge of the opening. Wrist strap 715 may include an adjustable fastener (not shown) to secure glove 700 to a received hand. Back pinky finger portion 716 extends from back portion 714 and has a back pinky finger length. Similarly, back ring finger portion 718 having a back ring finger length, back middle finger portion 720 having a back middle finger length, back index finger portion 722 having a back index finger length, and back thumb portion 724 having a back thumb length also extend from back portion 714. In some embodiments, back portion 714, back finger portions 716, 718, 720, and 722, and back thumb portion 724 are made substantially of a stretchable material.

With reference now to both FIGS. 7A and 7B, glove 700 also includes five curved finger gusset pairs 726, 728, 730, 732, and 734. Curved finger gusset pair 726 connects front pinky finger portion 704 and back pinky finger portion 716. Curved finger gusset pair 728 connects front ring finger portion 706 and back ring finger portion 718. Curved finger gusset pair 730 connects front middle finger portion 708 and back middle finger portion 720. Curved finger gusset pair 732 connects front index finger portion 710 and back index finger portion 722. Curved finger gusset pair 734 connects front thumb portion 712 and back thumb portion 724.

Embodiments of the present invention are discussed above that include curved finger sheaths to enhance grip. Embodiments are also contemplated that incorporate only seamless thumb, index finger, or pinky finger design, only a palm gusset, or any combination of curved finger sheaths, seamless design, and palm gusset.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

The invention claimed is:

1. An athletic glove capable of receiving a human hand, comprising:

a palm portion;

a front index finger portion extending from the palm portion and having a front index finger length;

a front middle finger portion extending from the palm portion and having a front middle finger length;

a front ring finger portion extending from the palm portion and having a front ring finger length;

a front pinky finger portion extending from the palm portion and having a front pinky finger length;

a front thumb portion extending from the palm portion and having a front thumb length;

a back portion connected to the palm portion such that an opening capable of receiving a human hand is formed between the back portion and the palm portion, the opening opposite the front finger portions;

a back index finger portion extending from the back portion and having a back index finger length that is longer than the front index finger length;

a back middle finger portion extending from the back portion and having a back middle finger length that is longer than the front middle finger length;

a back ring finger portion extending from the back portion and having a back ring finger length that is longer than the front ring finger length;

a back pinky finger portion extending from the back portion and having a back pinky finger length that is longer than the front pinky finger length;

a back thumb portion extending from the back portion and having a back thumb length;

two pairs of curved finger gussets connecting the front and back middle finger portions and the front and back ring finger portions, the curve of each pair of finger gussets determined by the difference in length between the corresponding front and back finger portions; and one curved finger gusset connecting each of the front and back index finger portions, such that the front and back index finger portions are a continuous piece of material that wraps around an index finger of a user; and at least one curved finger gusset connecting each of the front and back pinky finger portions, and the front and back thumb portions, wherein the length of each front finger portion and front thumb portion is selected to form a curve that minimizes bunching of the front finger portions and front thumb portion while a received hand grips a sporting implement.

2. The glove of claim 1, wherein the palm portion comprises multiple sections, and the glove further comprising a palm gusset made of a stretchable material connecting the multiple sections of the palm portion, the palm gusset minimizing bunching of the palm portion while the received hand grips the sporting implement.

3. The glove of claim 2, wherein the palm gusset forms an approximate "T" pattern.

4. The glove of claim 1, wherein only one curved finger gusset connects the front and back thumb portions, the connection located along an area corresponding to an outside of a thumb sheath when the glove is worn by a user, wherein the front and back thumb portions are a continuous piece of material that wraps around a thumb of the user, such that when the glove is worn and a sporting implement is gripped in a proper gripping position, no thumb seams come in contact with the sporting implement.

5. The glove of claim 4, wherein only one curved finger gusset connects the front and back index finger portions, the connection located along an area corresponding to an inside of an index finger sheath nearest to a middle finger sheath when the glove is worn by the user, where the front and back index finger portions are a continuous piece of material that wraps around an index finger of the user, such that when the glove is worn and a sporting implement is gripped in a proper gripping position, no index finger seams come in contact with the sporting implement.

6. The glove of claim 5, wherein only one curved finger gusset connects the front and back pinky finger portions, the connection located along the area corresponding to a side of a pinky finger sheath nearest to a ring finger sheath when the glove is worn by the user, wherein the front and back pinky finger portions are a continuous piece of material that wraps around a pinky finger of the user, such that when the glove is worn and a sporting implement is gripped in a proper gripping position, no pinky finger seams come in contact with the sporting implement.

7. An athletic glove capable of receiving a human hand, comprising:

a palm portion having multiple sections;

a palm gusset made of a stretchable material connecting the multiple sections of the palm portion;

a front index finger portion extending from the palm portion and having a front index finger length;

a front middle finger portion extending from the palm portion and having a front middle finger length;

a front ring finger portion extending from the palm portion and having a front ring finger length;

a front pinky finger portion extending from the palm portion and having a front pinky finger length;

a front thumb portion extending from the palm portion and having a front thumb length;

a back portion connected to the palm portion such that an opening capable of receiving a human hand is formed between the back portion and the palm portion, the opening opposite the front finger portions;

a back index finger portion extending from the back portion and having a back index finger length;

a back middle finger portion extending from the back portion and having a back middle finger length;

a back ring finger portion extending from the back portion and having a back ring finger length;

a back pinky finger portion extending from the back portion and having a back pinky finger length;

a back thumb portion extending from the back portion and having a back thumb length;

two pairs of curved finger gussets connecting the front and back middle finger portions and the front and back ring finger portions; and one curved finger gusset connecting each of the front and back index finger portions, such that the front and back index finger portions are a continuous piece of material that wraps around an index finger of a user; and at least one curved finger gusset connecting each of, the front and back pinky finger portions, and the front and back thumb portions, wherein the palm gusset minimizes bunching of the palm portion while the received hand grips a sporting implement.

8. The glove of claim 7, wherein the palm gusset forms an approximate "T" pattern.

9. The glove of claim 7, wherein:

the back index finger length is longer than the front index finger length, the back middle finger length is longer than the front middle finger length, the back ring finger length is longer than the front ring finger length, the back pinky finger length is longer than the front pinky finger length, the back thumb length is longer than the front thumb length, each finger gusset has a curve determined by the difference in length between the corresponding front and back finger or thumb portions, and the length of each front finger portion and front thumb portion is selected to form a curve that minimizes bunching of the front finger portions and front thumb portion while a received hand grips a sporting implement.

10. The glove of claim 7, wherein only one finger gusset connects the front and back thumb portions, the connection located along an area corresponding to an outside of a thumb sheath when the glove is worn by a user, wherein the front and back thumb portions are a continuous piece of material that wraps around a thumb of the user, such that when the glove is worn and a sporting implement is gripped in a proper gripping position, no thumb seams come in contact with the sporting implement.

11. The glove of claim 10, wherein only one finger gusset connects the front and back index finger portions, the connection located along an area corresponding to an inside of an index finger sheath nearest to a middle finger sheath when the glove is worn by the user, where the front and back index finger portions are a continuous piece of material that wraps around an index finger of the user, such that when the glove is worn and a sporting implement is gripped in a proper gripping position, no index finger seams come in contact with the sporting implement.

12. The glove of claim 11, wherein only one finger gusset connects the front and back pinky finger portions, the connection located along the area corresponding to a side of a pinky finger sheath nearest to a ring finger sheath when the glove is worn by the user, wherein the front and back pinky finger portions are a continuous piece of material that wraps around a pinky finger of the user, such that when the glove is worn and a sporting implement is gripped in a proper gripping position, no pinky finger seams come in contact with the sporting implement.

13. The glove of claim 11, wherein only one finger gusset connects the front and back pinky finger portions, the connection located along the area corresponding to a side of a pinky finger sheath nearest to a ring finger sheath when the glove is worn by the user, wherein the front and back pinky finger portions are a continuous piece of material that wraps around a pinky finger of the user, such that when the glove is worn and a sporting implement is gripped in a proper gripping position, no pinky finger seams come in contact with the sporting implement.

14. An athletic glove capable of receiving a human hand, comprising:

a palm portion;

a front index finger portion extending from the palm portion and having a front index finger length;

a front middle finger portion extending from the palm portion and having a front middle finger length;

a front ring finger portion extending from the palm portion and having a front ring finger length;

a front pinky finger portion extending from the palm portion and having a front pinky finger length;

a front thumb portion extending from the palm portion and having a front thumb length;

a back portion connected to the palm portion such that an opening capable of receiving a human hand is formed between the back portion and the palm portion, the opening opposite the front finger portions;

a back index finger portion extending from the back portion and having a back index finger length;

a back middle finger portion extending from the back portion and having a back middle finger length;

a back ring finger portion extending from the back portion and having a back ring finger length;

a back pinky finger portion extending from the back portion and having a back pinky finger length;

a back thumb portion extending from the back portion and having a back thumb length;

two pairs of finger gussets connecting the front and back middle finger portions and the front and back ring finger portions;

one curved finger gusset connecting each of the front and back index finger portions, such that the front and back index finger portions are a continuous piece of material that wraps around an index finger of a user; and at least one curved finger gusset connecting each of the front and back pinky finger portions; and one finger gusset connecting the front and back thumb portions along an area corresponding to an outside of a thumb sheath when the glove is worn by a user, the front and back thumb portions being a continuous piece of material that wraps around a thumb of the user, such that when the glove is worn and a sporting implement is gripped in a proper gripping position, no thumb seams come in contact with the sporting implement.

15. The glove of claim 14, wherein:

the back index finger length is longer than the front index finger length, the back middle finger length is longer than the front middle finger length, the back ring finger length is longer than the front ring finger length, the back pinky finger length is longer than the front pinky finger length, the back thumb length is longer than the front thumb length, each finger gusset has a curve determined by the difference in length between the corresponding front and back finger or thumb portions, and the length of each front finger portion and front thumb portion is selected to form a curve that minimizes bunching of the front finger portions and front thumb portion while a received hand grips a sporting implement.

16. The glove of claim 14, wherein the palm portion comprises multiple sections, and the glove further comprising a palm gusset made of a stretchable material connecting the multiple sections of the palm portion, the palm gusset minimizing bunching of the palm portion while the received hand grips the sporting implement.

17. The glove of claim 14, wherein only one finger gusset connects the front and back index finger portions, the connection located along an area corresponding to an inside of an index finger sheath nearest to a middle finger sheath when the glove is worn by the user, where the front and back index finger portions are a continuous piece of material that wraps around an index finger of the user, such that when the glove is worn and a sporting implement is gripped in a proper gripping position, no index finger seams come in contact with the sporting implement.

* * * * *